US005990425A

United States Patent [19]

McSwiggen

[11] Patent Number: 5,990,425

[45] Date of Patent: Nov. 23, 1999

[54] PROGRAMMABLE ELECTRICAL SWITCH

[75] Inventor: John P. McSwiggen, Elmhurst, Ill.

[73] Assignee: Knowles Electronics, Inc., Itasca, Ill.

[21] Appl. No.: 09/238,247

[22] Filed: Jan. 27, 1999

[51] Int. Cl.[6] ..... H01H 15/00

[52] U.S. Cl. ..... 200/16 R; 200/292; 29/622

[58] Field of Search ..... 200/16 R–16 D, 200/547–551, 243, 252, 280, 281, 284, 292; 29/622–846, 847, 884; 439/55, 68, 70, 72, 73, 83, 510, 525, 526, 527

[56] References Cited

U.S. PATENT DOCUMENTS

| | | | |
|---|---|---|---|
| 3,624,320 | 11/1971 | Eberhart et al. | 200/16 R |
| 4,001,490 | 1/1977 | Lynch | 174/88 R |
| 4,152,565 | 5/1979 | Rose | 200/291 |
| 4,353,610 | 10/1982 | Deters | 339/19 |
| 4,491,703 | 1/1985 | Jaklic | 200/16 D |
| 4,536,953 | 8/1985 | De Vera | 29/622 |

OTHER PUBLICATIONS

Wilbrecht Electronics, Inc. Product Data Sheet for Model 2005 Slide Switch, No Date.

Resistance Technology, Inc. Product Data Sheet for Slide Switch Model 21–2, No Date.

Resistance Technology, Inc. Product Data Sheet for Slide Switch Model 21–3, No Date.

*Primary Examiner*—Michael Friedhofer

*Attorney, Agent, or Firm*—Wallenstein & Wagner, Ltd.

[57] ABSTRACT

A programmable electrical switch having a housing and a plurality of single-switch-position conducting leads which are positioned in two substantially aligned rows is disclosed. Each of the leads has a proximal end that is disposed within the housing and a distal end that extends outwardly from the housing. The leads are disposed in the housing so that they are electrically independent of one another. The switch may also have a conducting bridge electrically interconnecting the leads in each of the rows. The switch also includes a moveable conductive contact that is positioned between a pair of opposing leads to electrically bridge a gap between the opposing leads.

10 Claims, 3 Drawing Sheets

FIG. 3
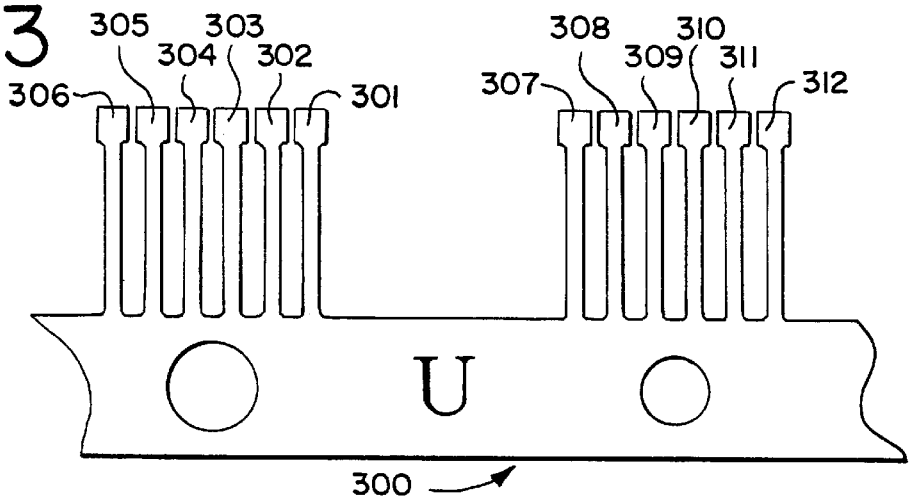
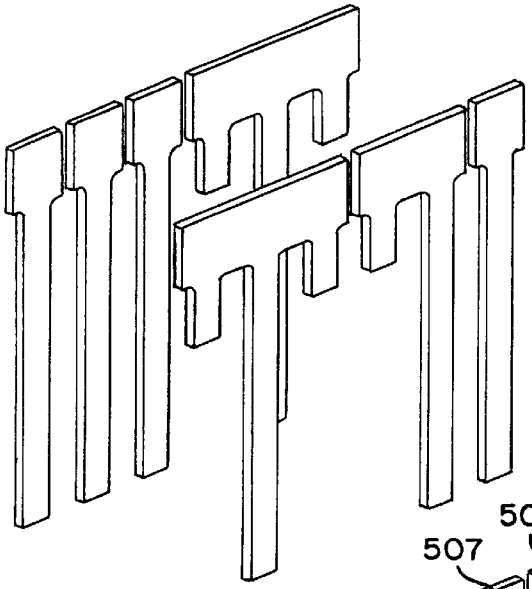
FIG. 4
PRIOR ART
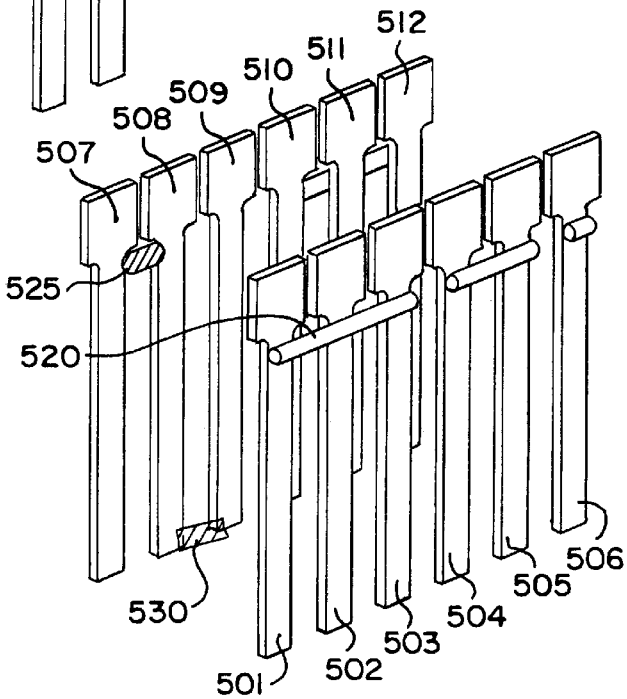
FIG. 5

PROGRAMMABLE ELECTRICAL SWITCH

DESCRIPTION

1. Technical Field

The present invention relates generally to a programmable electrical switch.

2. Background Of The Invention

Conventional electrical switches are manufactured with many functionally different configurations. The specific configuration that is determined by the application for which the switch is to be used. The drawback to these switches is that the manufacturers and their customers need to stock many different configurations to ensure the availability of switches comprising the needed configurations. Accordingly, a need has been identified for a universal electrical switch that is customer programmable.

SUMMARY OF THE INVENTION

The present invention is directed to an improved electrical switch, wherein the switch is programmable by a customer. The improved switch is comprised of a housing and a plurality of single-switch-position conducting leads positioned in two substantially parallel rows. Each lead has a proximal end disposed within the housing and a distal end extending outwardly from the housing. The switch also comprises a conducting bridge electrically interconnecting the leads in each of the rows, and a moveable conductive contact positioned between a pair of opposing leads to electrically bridge a gap between the opposing leads. The switch is then programed by a customer by enabling a plurality of leads within the rows to be electrically separated by cutting or burning through the conducting bridge between the leads. It is also contemplated that the electrical switch may not include conductive bridges, but would have all of its leads electrically independent from the others. The customer would then electrically interconnect the necessary leads by soldering between the leads outside of the housing or simply short between the necessary leads by making the connections on the circuit board that the switch is placed upon.

BRIEF DESCRIPTION OF THE DRAWINGS

FIG. 3 is a universal lead frame according to the present invention;

FIG. 4 is a prior art insert having a combination of single-switch-position conducting leads and multiple-switch-position conducting leads;

FIG. 5 shows leads in accordance with the present invention that are single-switch-position conducting leads electrically interconnected by a conducting bridge after the bridge has been severed in multiple places.

DETAILED DESCRIPTION OF THE PREFERRED EMBODIMENT

While this invention is susceptible of embodiments in many different forms, there will herein be described in detail preferred embodiments of the invention with the understanding that the present disclosure is to be considered as an exemplification of the principles of the invention and is not intended to limit the broad aspects of the invention to the embodiments illustrated.

Figure 1:
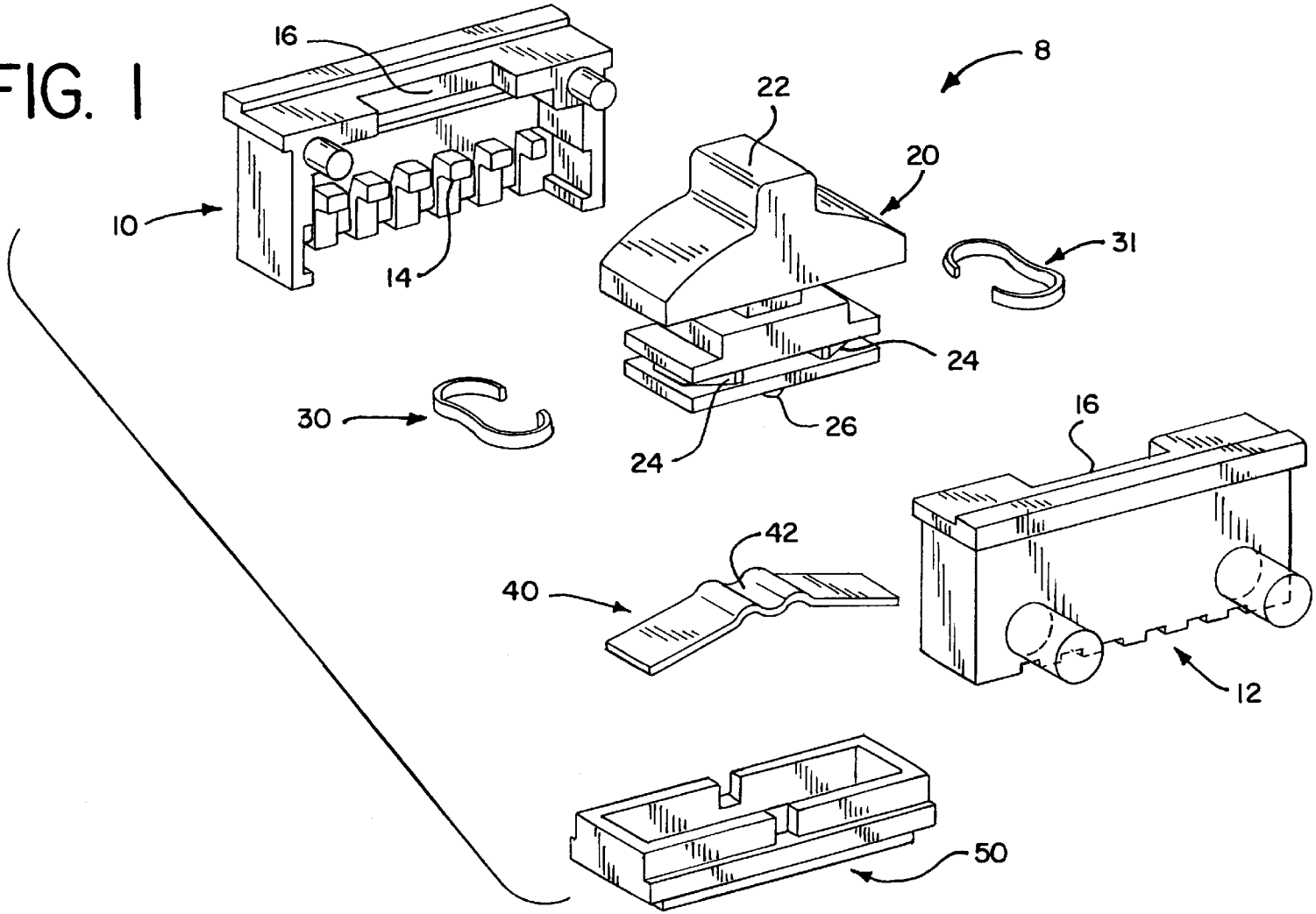
FIG. 1 is an exploded view of one embodiment of the present invention.

FIG. 1 exemplifies an embodiment of the components in an electrical switch 8. While this embodiment is of a slide switch, other types of switches could also be utilized and also receive the benefits of this invention. The switch 8 includes a housing that is formed of two halves 10, 12. When the two halves 10, 12 are formed together, they secure a driver 20 in place. Each of the halves 10, 12 has a recess 16 in the top surface so as to form a rectangular opening in the top surface when the housing halves 10, 12 are formed together. The housing halves 10, 12 have a plurality of supports 14 located on the inside of the halves 10, 12 to secure the conducting leads 301–312 (FIG. 3) inside the housing. The supports 14 are arranged longitudinally within the housing so that they run in two substantially parallel rows when the housing halves 10, 12 are formed together.

FIG. 3 illustrates a lead frame 300 with twelve single-switch position conducting leads 301–312 still connected to the lead frame 300. Each of the leads 301–312 has a proximal end that is disposed within the housing and a distal end extending outwardly from the housing. As seen in FIG. 3, the distal ends of the leads 301–312 are the ends connected to the lead frame 300. It is the distal ends of the leads 301–312 that are typically connected to a circuit board. As can be seen from FIG. 3, when the leads 301–312 are secured within the housing and severed from the lead frame 300, they are each electrically independent of all other leads. In other words, none of the leads 301–312 is interconnected within the housing. This will be explained in greater detail.

The switch 8 in FIG. 1 also utilizes a moveable conductive contact that is positioned between a pair of opposing leads to electrically bridge a gap between the opposing leads. The moveable conductive contact comprises a driver 20 and conducting contacts 30, 31. The driver 20 is secured within the housing to permit longitudinal movement of the driver 20, in the direction of the rows of supports 14. The driver 20 has a handle 22 which extends outwardly through the opening in the housing which is formed by recesses 16. The handle 22 allows pressure to be applied in order to physically move, or in this case, slide the drivers between switch positions.

FIG. 1 illustrates a driver having two contacts 30, 31. It is possible however, that the driver 20 could have only one contact or more than two contacts. The driver 20 has two locking portions 24 to secure the contacts 30, 31 onto the driver 20. The locking portions 24 are located within the housing and are adapted to receive the contacts 30, 31. The contacts 30, 31 are generally in a C-shaped configuration with the opening of the C being slightly smaller than the widest portion of the locking portion 24. The conductive contacts 30 and 31 are fixed on the driver so that they make physical and electrical contact with opposing leads in the rows and electrically bridge the gap between the opposing leads.

The driver 20 also has a sliding portion that is located directly opposite the handle. This is essentially the bottom surface of the driver 20. The sliding portion further has a rounded protrusion 26 to assist in holding the driver 20 in one of at least two switch positions. The rounded protrusion 26 cooperates with a detent spring 40 as shown in FIG. 1. The detent spring 40 is located within the housing and is held in place by base 50. The base fits between the housing halves 10, 12 to form a bottom surface of the housing. The detent sprint 40 is for a switch having three switch positions.

Switches may have only two positions or possibly more than three positions, and the detent spring 40 would thus be designed accordingly. The detent spring 40 exerts pressure upon the driver 20 to selectively hold the driver 20 in one of at least two positions within the housing. The detent spring 40 is formed so that it angles downward at the ends and has a rounded recession 42 in the center. The rounded protrusion 26 rests in one of these three positions when the driver 20 is in one of the three switch positions.

As previously mentioned, FIG. 3 illustrates a universal insert lead frame 300. It is universal because each of the leads 301–312 are electrically independent of one another when they are mounted within the housing and the lead frame 300 is removed. There are twelve leads 301–312 shown in FIG. 3. Twelve leads are necessary to have two substantially parallel rows of six leads. Additionally, six leads are needed in each row when a three position switch and a driver with two contacts are used.

FIG. 5 illustrates twelve leads 501–512 arranged longitudinally in two substantially parallel rows. Each of the leads has a corresponding lead in the opposite row. For example, lead 501 and lead 507 oppose each other, since they are directly opposite each other when fixed within the housing. It similarly follows for the remaining leads 502–506 and 508–512, respectively. These opposing leads are connected to one another by means of the contacts 30, 31, illustrated in FIG. 1. When the driver 20 is in the first switch position, contact 30 would electrically connect leads 501 and 507, and contact 31 would electrically connect leads 504 and 510. When the driver 20 is moved to the second switch position, contact 30 would then electrically connect leads 502 and 508, and contact 31 would electrically connect leads 505 and 511. Lastly, when the driver 20 is moved to the third switch position, contact 30 would then electrically connect leads 503 and 509, and contact 31 would electrically connect leads 506 and 512.

Another aspect of the present invention includes the addition of a conducting bridge to electrically interconnect the leads in each of the rows. The conducting bridge could be any type of conducting material, but the material shown in FIG. 5 is a small metallic wire 520 that has been welded to the conducting leads. The bridge wires are welded to the leads 501–506 and 507–512. Hence, two separate wires are used for the two rows. However, one continuous wire could be used for both rows if it is desired to allow the customer to separate the wire between the two rows. It is also intended that the bridge wires 520 are placed near the proximal ends of the leads, but low enough so that they remain outside the housing. This will allow access to the bridge wires 520 once the housing halves 10, 12 are formed together, and at the same time will not interfere with the placement of the switch onto a circuit board. This placement of the bridge wire 520 also allows for the selective separation of the bridge wire between desired leads. For example, FIG. 5 shows a bridge wire 520 that has already been separated between leads 503 and 504 and between leads 505 and 506. The separation of the bridge wire 510 can be accomplished in a variety of ways, such as cutting or burning through the bridge wire. This feature allows a user to program the switch in a great variety of configurations. Therefore, the need to manufacture and stock several varieties of switches containing different configurations is eliminated.

Figure 2:
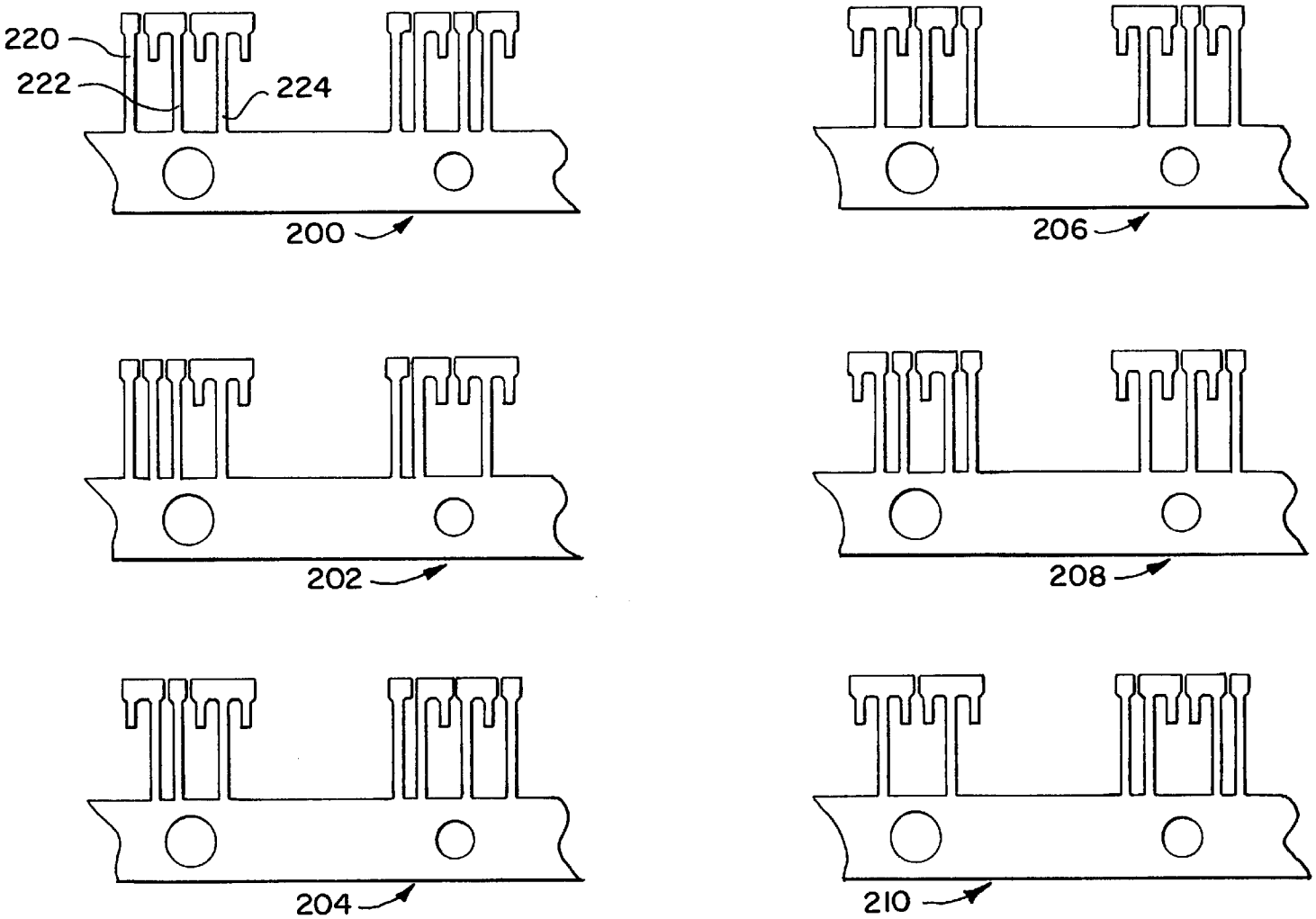
FIG. 2 PRIOR ART
FIG. 2 shows several configurations of lead frames used in the prior art which have combinations of single-switch-position conducting leads and multiple-switch-position conducting leads.

Once the user has programmed the switch by burning or cutting through the bridge wire 520, the switch will function the same as a prior art switch configured similarly. FIG. 2 illustrates several configurations 200–210 using the old leads as found in the prior art. The leads used prior to the present invention were single-switch-position, double-switch-position, or triple-switch-position leads. For example: lead 220 is a single-switch-position lead, lead 222 is a double-switch-position lead, and lead 224 is a triple-switch-position lead. As can be seen from FIG. 2, many different configurations are necessary to provide users with a switch tailored to their specifications. The present invention enables one switch to be purchased and stocked, and thereafter programmed to produce the desired configuration.

It is also contemplated that in a modified embodiment, the electrical switch may not include conductive bridges. The switch would therefore have all of its leads electrically independent from the others. The customer would then electrically interconnect the necessary leads by soldering, represented at 525, between the leads outside of the housing or simply short between the necessary leads by making the connections, represented at 530, on the circuit board the switch is placed upon. This is essentially the opposite of the previous method described, but produces the same result and benefits.

In another modification of the above embodiment, it is contemplated that the housing halves 10, 12 have access ports extending longitudinally in the direction of the rows to allow access through the housing to permit selective electrical interconnection of a plurality of the leads. This could be accomplished by bridging between the leads within the housing with a small amount of solder. The actual connections would thus be within the housing in this embodiment. Therefore, the user would essentially modify a universal programmable switch to meet its needed configuration.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

I claim:

1. A programmable electrical switch comprising:

a housing;

a plurality of single-switch-position conducting leads positioned in two substantially aligned rows, each of said plurality of leads having a proximal end disposed within the housing and a distal end extending outwardly from the housing;

a conducting bridge electrically interconnecting the leads in each of the rows; and a moveable conductive contact positioned between a pair of opposing ones of said leads to electrically bridge a gap between the opposing ones of said leads;

wherein portions of the conducting bridge are selectively removed or interrupted to alter the configuration of the switch.

2. A programmable electrical switch according to claim 1 wherein the conducting bridge is a wire welded across the leads.

3. A programmable electrical switch according to claim 1 wherein a number of said leads within the rows are electrically separated by cutting through the conducting bridge between the number of said leads.

4. A programmable electrical switch according to claim 1 wherein a number of said leads within the rows are electrically separated by burning through the conducting bridge between the number of said leads.

5. A programmable electrical switch comprising:

a housing;

a plurality of single-switch-position conducting leads positioned in two substantially aligned rows, each of said plurality of leads having a proximal end disposed within the housing and a distal end extending outwardly from the housing, each of the leads disposed so that the leads are electrically independent of one another; and a moveable conductive contact positioned between a pair of opposing conductive leads to electrically bridge a gap between the opposing leads;

wherein interconnections between the leads are selectively added to the switch after assembly.

6. A programmable electrical switch according to claim 5 wherein a number of said leads within the rows are electrically interconnected by soldering between the number of said leads.

7. A programmable electrical switch according to claim 5 wherein a number of said leads within the rows are electrically interconnected by conductive material on a circuit board that the housing is fixed upon.

8. A programmable electrical switch comprising:

a housing;

a plurality of single-switch-position conducting leads positioned in two substantially aligned rows, each of said plurality of leads having a proximal end disposed within the housing and a distal end extending outwardly from the housing, each of the leads disposed so that the leads are electrically independent of one another;

access ports on a first and second side of the housing extending longitudinally in a direction of the rows to allow access through the housing to permit selective electrical interconnection of a number of said leads; and a moveable conductive contact positioned between a pair of opposing ones of said leads to electrically bridge a gap between the opposing ones of said leads.

9. A programmable electrical switch according to claim 8 wherein a selective number of said leads within the rows are electrically interconnected by soldering between the number of said leads.

10. A programmable electrical switch according to claim 8 wherein a selective number of said leads within the rows are electrically interconnected by shorting between the number of said leads.

* * * * *